US005982273A

United States Patent [19]

Shibata

[11] Patent Number: 5,982,273

[45] Date of Patent: Nov. 9, 1999

[54] MULTI-ELEMENT TYPE CHIP DEVICE AND PROCESS FOR MAKING THE SAME

[75] Inventor: Osamu Shibata, Kyoto, Japan

[73] Assignee: Rohm Co., Ltd., Kyoto, Japan

[21] Appl. No.: 08/973,528

[22] PCT Filed: Jul. 1, 1996

[86] PCT No.: PCT/JP96/01830

§ 371 Date: Dec. 9, 1997

§ 102(e) Date: Dec. 9, 1997

[87] PCT Pub. No.: WO97/02579

PCT Pub. Date: Jan. 23, 1997

[30] Foreign Application Priority Data

Jul. 5, 1995 [JP] Japan ..... 7-169489

[51] Int. Cl.[6] ..... H01C 1/01

[52] U.S. Cl. ..... 338/320; 338/260; 338/309

[58] Field of Search ..... 338/320, 260, 338/309, 239, 295; 29/620, 603

[56] References Cited

U.S. PATENT DOCUMENTS 5,334,968 8/1994 Negoro ..... 338/320

FOREIGN PATENT DOCUMENTS 1-152701 6/1989 Japan ..... H01C 7/00

1-184906 7/1989 Japan ..... H01C 17/24

3-215901 9/1991 Japan ..... 338/314

*Primary Examiner*—Michael L. Gellner

*Assistant Examiner*—Richard K. Lee

*Attorney, Agent, or Firm*—Michael D. Bednarek; Crowell & Moring LLP

[57] ABSTRACT

A multi-element type chip device of the present invention includes an elongate chip substrate (10), 2n pairs of opposed electrodes (12*a*) [n representing a positive integer] formed on a surface of the chip substrate (10) at a generally constant interval longitudinally of the chip substrate, device elements (131–134) each formed between a respective pair of electrodes, and a protective coating (14–16) formed to cover the device elements (131–134) in a row extending longitudinally of the chip substrate (10). A (2m−1)th device element (131, 133) [m representing a positive integer not exceeding n] as counted from one end **(10*a*) of the chip substrate (10) has a widthwise center which is offset from a widthwise center of a corresponding pair of electrodes (12*a*) toward the other end (10*b*) of the chip substrate (10). A (2*m*)th device element (132, 134) as counted from the one end of the chip substrate (10) has a widthwise center which is offset from a widthwise center of a corresponding pair of electrodes (12*a*) toward the one end (10*a*) of the chip substrate (10)**.

9 Claims, 15 Drawing Sheets

MULTI-ELEMENT TYPE CHIP DEVICE AND PROCESS FOR MAKING THE SAME

TECHNICAL FIELD

The present invention relates to a multi-element type chip device wherein a plurality of device elements are arranged on a single chip substrate in a row, and a process for making the same.

BACKGROUND ART

A multi-element type chip resistor is already known as an example of a multi-element type chip device wherein a plurality of device elements are arranged on a single chip substrate in a row. Typically, a prior art multi-element type chip resistor has such a structure as shown in FIGS. 13 through 15.

As illustrated in FIGS. 13 through 15, the prior art multi-element type chip resistor has a chip substrate 10' made of an insulating material such as alumina ceramic. The substrate 10' has side edges which are spaced widthwise and formed with four pairs of longitudinally spaced projections 11'. The projections 11' in each pair are opposed to each other widthwise of the substrate. Each of the projections 11' has an upper surface formed with a thick-film primary electrode 12*a'* made of a conductive paste such as silver-palladium paste. A thick-film resistor element 13' made of ruthenium oxide paste for example is printed to bridge between each pair of primary electrode 12*a'*. The primary electrode 12*a'* is held in conduction with a secondary electrode 12*b'* extending onto the lower surface of the substrate 10'.

As shown in FIGS. 14 and 15, each resistor element 13' is normally covered by three thick-film printed glass layers which include an undercoat layer 14', a middle-coat layer 15' and an overcoat layer 16'. The undercoat layer 14' is provided to suitably perform laser trimming of the resistor element for resistance adjustment without surface roughening. The middle-coat layer 15' is provided to cover a laser-trimmed slit 17' (FIG. 13) of the resistor element 13'. The overcoat layer 16 protects the resistor element 13' as a whole.

Similarly to a single-element type chip resistor, the multi-element type chip resistor having the above-described structure may be conveniently manufactured by a master substrate 18' to which a thick-film printing method is performed, as shown in FIG. 16. The master substrate 18' is formed with vertical divisional grooves 19' and intersecting horizontal divisional grooves 20' for division into a plurality of unit substrates, as well as with through-holes 21' arranged along the horizontal divisional grooves 20'. The vertical divisional grooves 19' and the horizontal divisional grooves 20' may be formed, for example, by pressing blades against a surface of an non-baked substrate green sheet. The through-holes 21' may be formed by punching the same substrate green sheet.

In making multi-element type chip resistors, primary electrodes 12*a'* are simultaneously formed at respective regions of the master substrate 18' corresponding to the unit chips by printing and baking.

Then, resistor elements 13' are simultaneously formed by printing and baking.

Then, an undercoat layer 14' is simultaneously formed by printing and baking. At this stage, measuring probes (not shown) are brought into contact with each pair of electrodes 12*a'* while performing laser trimming (formation of a slit 17') until the corresponding resistor element 13' will have a target resistance.

Then, a middle-coat layer 15' and an overcoat layer 16' are successively formed by printing and baking.

Then, the master substrate 18' is divided along the horizontal divisional grooves 20', thereby providing substrate bars each including a plurality of longitudinally connected unit chip substrates.

Then, a conductive paste is applied to each substrate bar and baked to form secondary electrodes 12*b'* in conduction with the primary electrode 12*a'* on the obverse surface side.

Finally, the substrate bars are divided along the vertical divisional grooves 19', thereby providing a plurality of multi-element type chip resistors having the structure illustrated in FIGS. 13 through 15.

As appreciated from FIG. 13, each of the four resistor elements 13' formed on the same chip substrate 10' is symmetrical in plan view configuration with respect to an electrode-to-electrode center line C, and the width of the resistor element is enlarged longitudinally of the chip substrate 10' as much as possible. As shown in FIG. 14, on the other hand, the end edges 14*a'* of the undercoat layer 14' should be located beyond the resistor elements 13' at both ends of the chip substrate 10', whereas the middle-coat layer 15' and the overcoat layer 16' should have their respective end edges 15*a'*, 16*a'* located beyond the end edges 14*a'* of the undercoat layer 14'. This is because, as represented in FIG. 13, the laser trimmed slit 17' starts from a side edge of the resistor element 13', thereby making necessary for the undercoat layer 14' to cover the resistor element 13' over its entire width. Further, since the undercoat layer 14' generally has a poor acid resistance, the middle-coat layer 15' and the overcoat layer 16' need to entirely cover the undercoat layer 14' to prevent corrosion thereof at the time of plating the electrodes with solder.

According to the prior art shown in FIG. 13, each resistor element 13' is wide and symmetrical (with respect to the electrode-to-electrode center line C), the dimension $L_1$ between a side edge 10*a'* of the resistor element 13' at each end of the chip substrate 10' and the corresponding end edge 10*a'* of the chip substrate becomes small. As a result, it is extremely difficult to locate the respective end edges 14*a'*, 15*a'*, 16*a'* of the undercoat layer 14', middle-coat layer 15' and overcoat layer 16' within the small dimension $L_1$ without any printing deviations.

If, due to a printing deviation or the like, part of the resistor elements 13' is exposed without being covered by any one of the glass layers, solder may deposit on the exposed part at the time of plating the electrodes with solder, thereby causing a shorting problem. Further, if the undercoat layer 14' is partially exposed by being incompletely covered by the middle-coat layer 15' and the overcoat layer 16', the undercoat layer 14' which is made of a material having a poor acid resistance may be corroded at the time of plating the electrodes with solder, and the solder may deposit on a resistor element to cause a shorting trouble.

A countermeasure for eliminating the problems caused by printing deviations of the respective glass layers is to drastically reduce the width of each resistor element 13'. However, such a countermeasure results in a new problem of reducing the range in which the resistance of the resistor element is adjusted by laser trimming.

Another countermeasure is to form the middle-coat layer 15' continuously over adjacent chip substrates (in the state before the master substrate 18' is divided). However, according to this countermeasure, the vertical divisional grooves 19' sectioning the adjacent chip substrates are filled with a hard glass material, so that division of the master substrate cannot be performed properly to result in irregularity in the configuration of the divided chip substrate. Further, glass fragments may scatter around at the time of dividing the master substrate, thereby deteriorating the surrounding environment.

DISCLOSURE OF THE INVENTION

Therefore, an object of the present invention is to provide a multi-element type chip device, in particular a chip resistor, which is capable of eliminating or reducing the above-described problems of the prior art.

According to a first aspect of the present invention, there is provided a multi-element type chip device comprising an elongate chip substrate, 2n pairs of opposed electrodes [n representing a positive integer] formed on a surface of the chip substrate at a generally constant interval longitudinally of the chip substrate, device elements each formed between a respective pair of electrodes, and a protective coating formed to cover the device elements in a row extending longitudinally of the chip substrate; wherein a (2m−1)th device element [m representing a positive integer not exceeding n] as counted from one end of the chip substrate has a widthwise center which is offset from a widthwise center of a corresponding pair of electrodes toward the other end of the chip substrate; and wherein a (2m)th device element as counted from said one end of the chip substrate has a widthwise center which is offset from a widthwise center of a corresponding pair of electrodes toward said one end of the chip substrate.

The advantages of the multi-element type chip device having the above-described structure will be specifically described on the basis of the embodiment to be described later.

According to a preferred embodiment of the present invention, each of the device elements is a resistor element.

Further, the protective coating may comprise an undercoat layer formed to cover the device elements in a row extending longitudinally of the chip substrate, a middle-coat layer formed to cover the undercoat layer, and an overcoat layer formed to cover the middle-coat layer. In this case, the undercoat layer may advantageously extend longitudinally of the chip substrate throughout and beyond all of the device elements, the middle-coat layer extending longitudinally of the chip substrate at least as much as the undercoat layer extends, the overcoat layer extending longitudinally of the chip substrate to a position beyond the middle-coat layer but short of each edge of the chip substrate.

According to a second aspect of the present invention, there is provided a process for making multi-element type chip devices comprising the steps of: preparing a master substrate formed with vertical divisional grooves and horizontal divisional grooves for defining elongate unit regions arranged in plural rows and columns; forming 2n pairs of opposed electrodes [n representing a positive integer] in each unit region at a generally constant interval longitudinally thereof; forming device elements each extending between a respective pair of electrodes in said each unit region; and forming a protective coating to cover the device elements in a row extending longitudinally of said each unit region; wherein a (2m−1)th device element [m representing a positive integer not exceeding n] as counted from one end of said each unit region is formed to have a widthwise center which is offset from a widthwise center of a corresponding pair of electrodes toward the other end of said each unit region; and wherein a (2m)th device element as counted from said one end of said each unit region is formed to have a widthwise center which is offset from a widthwise center of a corresponding pair of electrodes toward said one end of said each unit region.

Other objects, features and advantages of the present invention will become apparent from the following description of the embodiment given with reference to the accompanying drawings.

BEST MODE FOR CARRYING OUT THE INVENTION

A preferred embodiment of the present invention will be specifically described below with reference to FIGS. 1–12.

Figure 1:
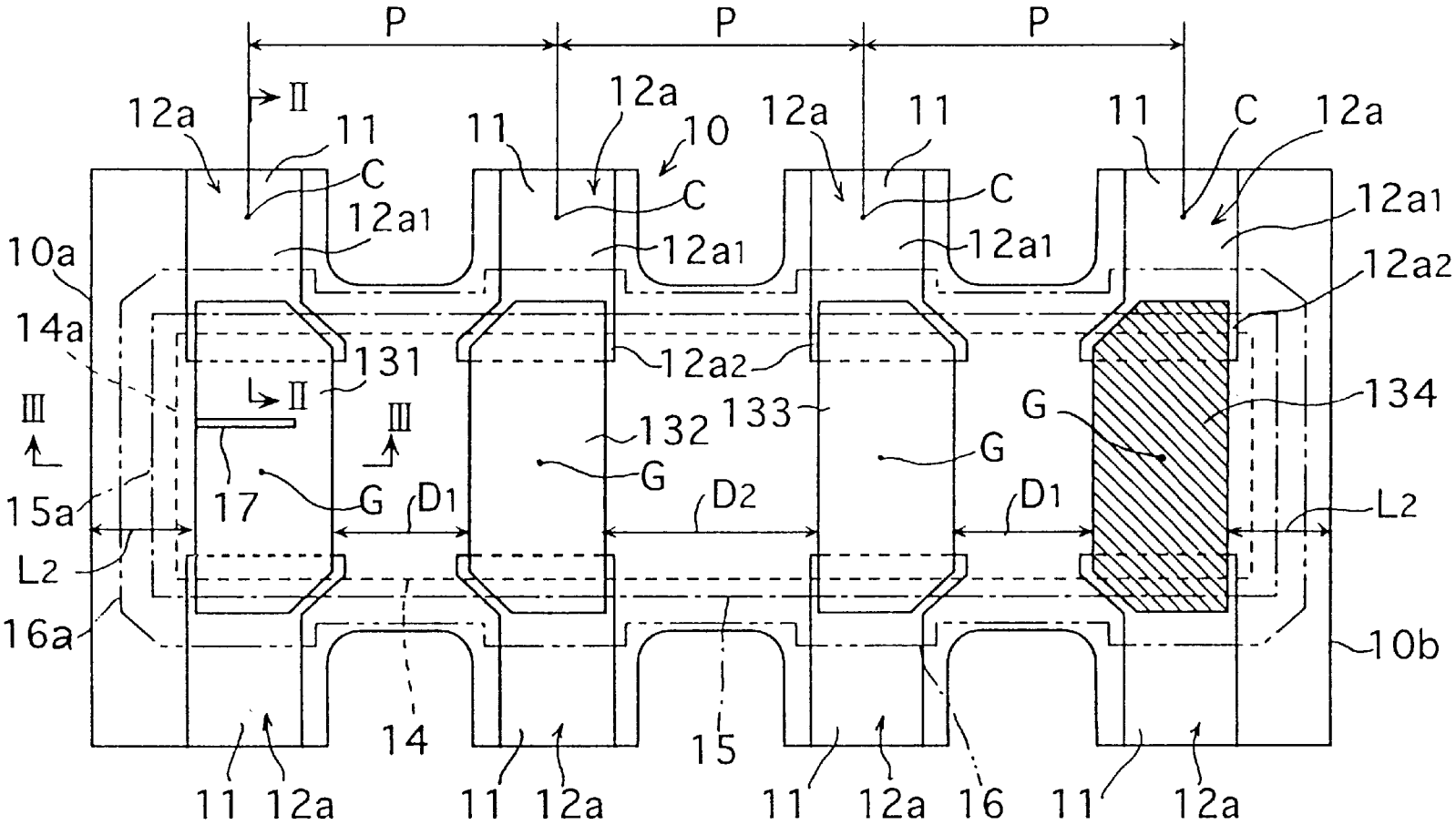
FIG. 1 is a plan view showing a chip resistor as an embodiment of multi-element type chip device according the present invention.
Figure 2:
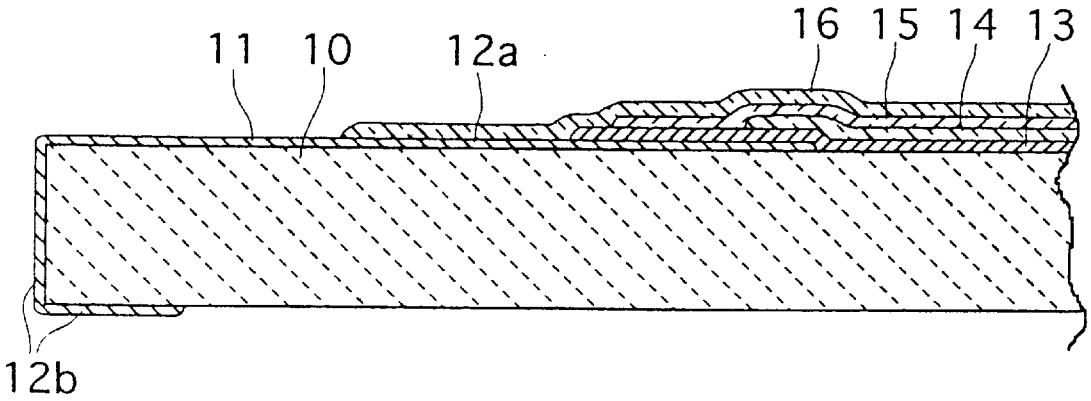
FIG. 2 is an enlarged sectional view taken along lines II—II in FIG. 1.
Figure 3:
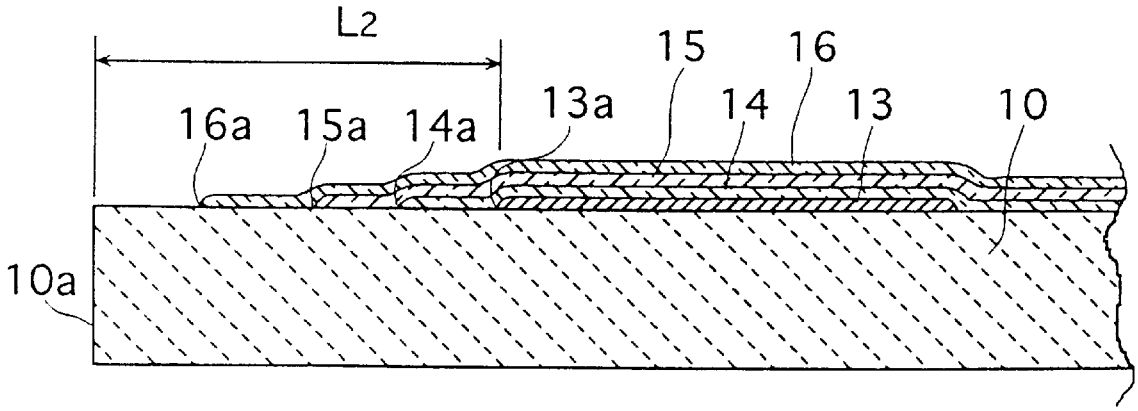
FIG. 3 is an enlarged sectional view taken along lines III—III in FIG. 1.

FIGS. 1 through 3 show a multi-element type chip device embodying the present invention. In the illustrated embodiment, the chip device is a chip resistor which comprises four resistor elements arranged in a row. FIG. 1 is a plan view of the same chip resistor. FIG. 2 is a sectional view taken along lines II—II in FIG. 1, whereas FIG. 3 is a sectional view taken along lines III—III in FIG. 1.

Figure 13:
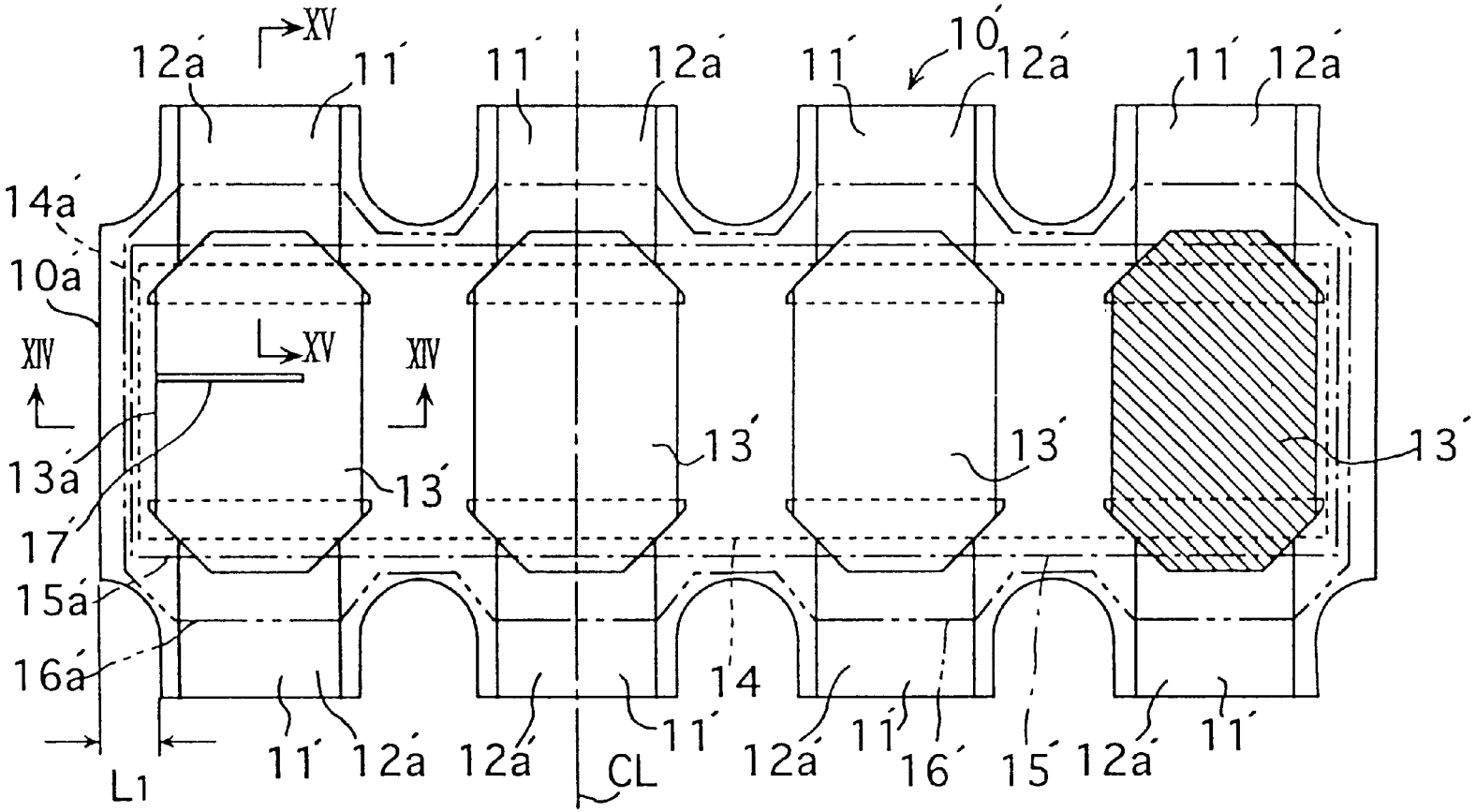
Fig. 13 PRIOR ART
FIG. 13 is a plan view showing a prior art multi-element type chip resistor.
Figure 14:
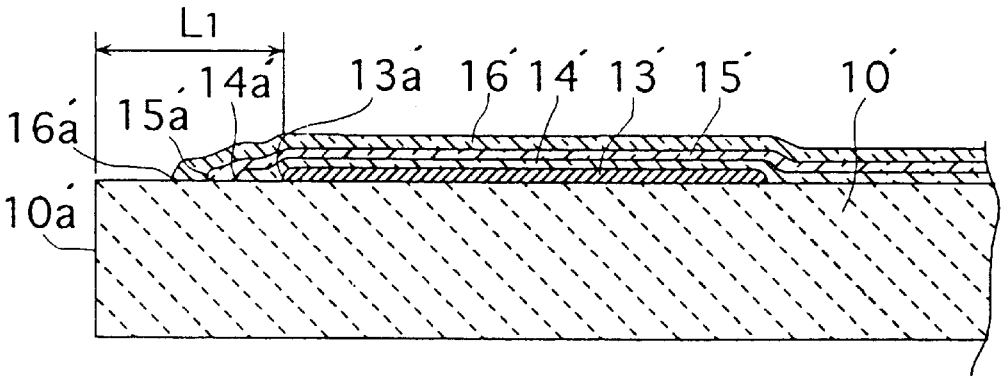
Fig. 14 PRIOR ART
FIG. 14 is an enlarged sectional view taken along lines XIV—XIV in FIG. 13.
Figure 15:
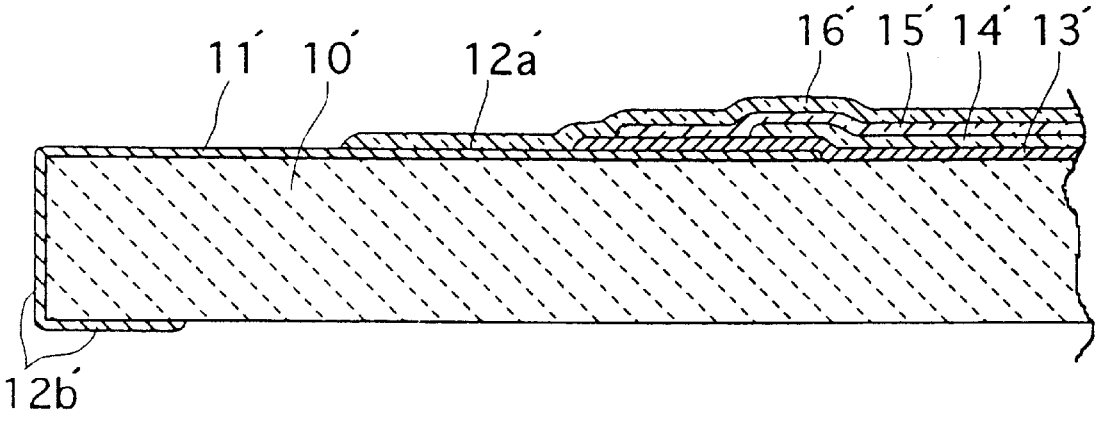
Fig. 15 PRIOR ART
FIG. 15 is an enlarged sectional view taken along lines XV—XV in FIG. 13.
Figure 16:
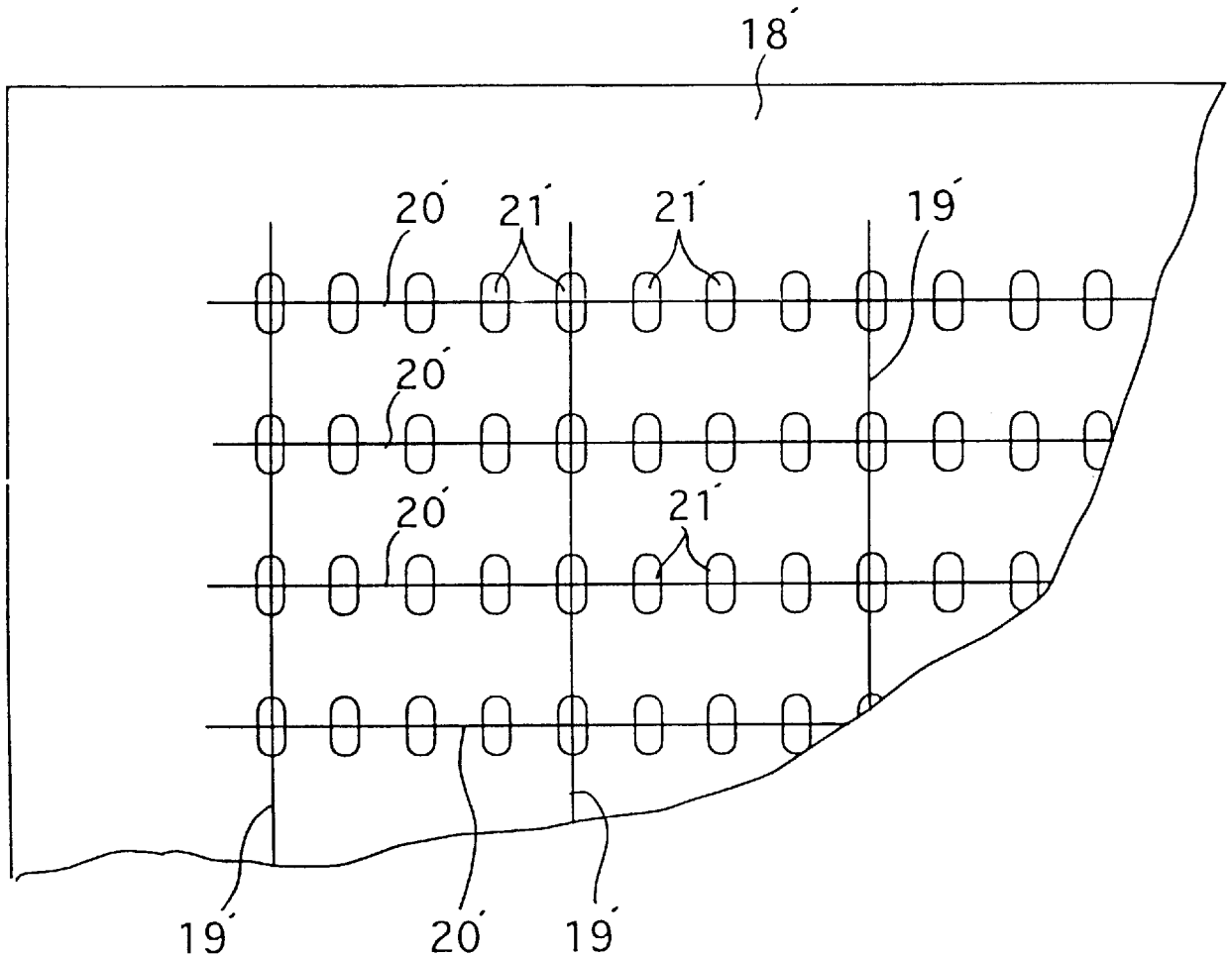
Fig. 16 PRIOR ART
FIG. 16 is a fragmentary plan view showing a master substrate used for making the chip resistor illustrated in FIG. 13.
Figure 17:
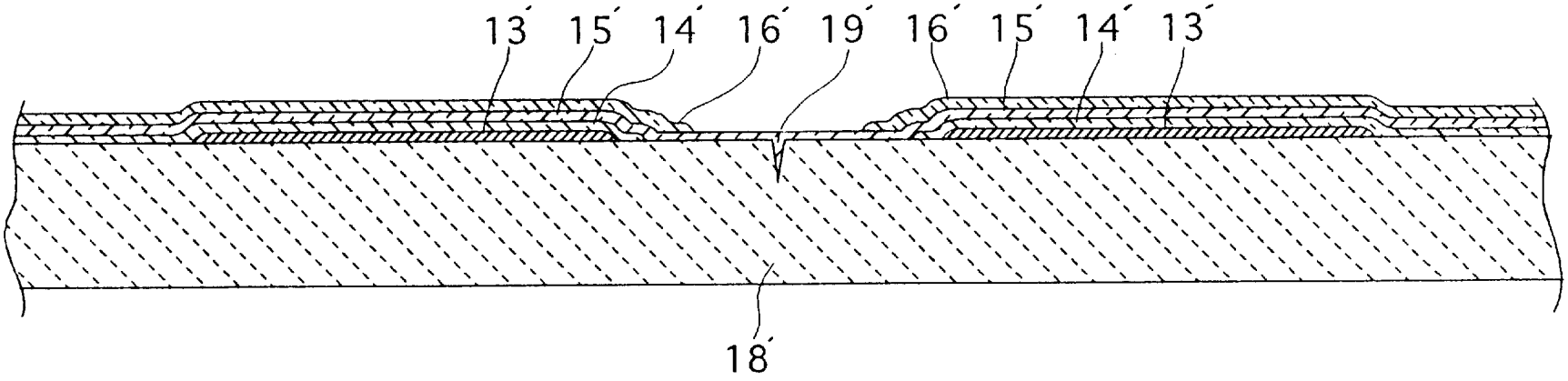
Fig. 17 PRIOR ART
FIG. 17 is an enlarged sectional view showing another prior art multi-element type chip resistor.

As shown in FIG. 1, the resistor of the present embodiment has the same basic structure as the prior art resistor shown in FIG. 13. Specifically, the chip resistor 1 has an elongate chip substrate 10 made of alumina ceramic or the like. The substrate 10 has side edges which are spaced widthwise and formed with four pairs of longitudinally spaced projections 11. The projections 11 in each pair are opposed to each other widthwise of the substrate 10. Each of the projections 11 has an upper surface formed with a primary electrode 12a made of a conductive paste such as silver-palladium paste. The primary electrode 12*a* has a rectangular base portion $\mathbf{12}a_1$ formed on the corresponding projection, and a connecting portion $\mathbf{12}a_2$ extending inwardly from the base portion. The base portion $\mathbf{12}a_1$ is held in conduction with a secondary electrode 12*b* extending onto the lower surface of the substrate 10.

Similarly to the prior art shown in FIG. 13, the pitch P between the centers of the base portions $12a_1$ of the primary electrodes 12 at the respective pairs of projections 11 is constant or generally constant. However, according to the present embodiment, the respective connecting portions $12a_2$ are not symmetrical longitudinally of the substrate 10, but are alternately offset longitudinally of the substrate 10.

Resistor elements 131–134 (hereinafter referred to as "first-fourth resistor elements" as counted from the left side of FIG. 1) are formed by printing ruthenium oxide paste or the like in a thick film to extend between the respective pairs of electrodes 12*a*. The plan view configuration of these resistor elements 131–134 is not symmetrical longitudinally of the substrate 10. Specifically, the first and third resistor elements 131, 133 have a respective widthwise center G which is offset rightward in FIG. 1 relative to the widthwise center C of the base portion $12a_1$ of the corresponding electrode 12*a*, whereas the second and fourth resistor elements 132, 134 have a respective widthwise center G which is offset leftward in FIG. 1 relative to the widthwise center C of the base portion $12a_1$ of the corresponding electrode 12*a*. As a result, the interval $D_1$ between the first and second resistor elements 131, 132 as well as the distance $D_1$ between the third and fourth resistor elements 133, 134 becomes smaller, whereas the distance $D_2$ between the second and third resistor elements 132, 133 becomes larger. Similarly, the distance $L_2$ between the first resistor element 131 and the left end edge 10*a* of the substrate 10 as well as the distance $L_2$ between the fourth resistor element 134 and the right end edge 10*b* of the substrate 10 increases.

The resistor elements 131–134 and part of the primary electrodes 12*a* are covered in a train by an undercoat layer 14 (indicated by broken lines in FIG. 1) which is made of an insulating material such as glass. The longitudinally spaced end edges 14*a* of the undercoat 14 extend beyond the first resistor element 131 and the fourth resistor element 134. The undercoat layer 14 is provided to suitably perform laser trimming of the resistor elements for resistance adjustment without surface roughening, and therefore may be made of a relatively weak material. After forming the undercoat layer 14, the resistance adjustment by laser trimming (formation of a slit 17) is performed by bringing unillustrated probes into contact with each pair of primary electrodes 12*a* for resistance measurement until the measured resistance reaches a desired value.

The undercoat layer 14 is covered by a middle-coat layer 15 (indicated by single-dashed chain lines in FIG. 1) which is made of an insulating material such as glass. The longitudinally spaced end edges 15*a* of the middle-coat layer 15 may be aligned with the end edges 14*a* of the undercoat layer 14 or may extend beyond them. The middle-coat layer 15 is provided to make the laser-trimmed slit 17 of each resistor element 131–134 filled with an insulating material.

The middle-coat layer 15 is covered by an overcoat layer (indicated by double-dashed chain lines in FIG. 1) which is also made of an insulating material such as glass. The longitudinally spaced end edges 16*a* of the overcoat layer 16 extends beyond the end edges 15*a* of the middlecoat layer 15. The overcoat layer 16 combined with the undercoat layer 14 and the middle-coat layer 15 constitutes a protective coating for protecting the device as a whole.

As previously described, the resistor elements 131–134 of the chip resistor 1 according to the present embodiment rendered offset alternately in the opposite directions longitudinally of the substrate 10, so that the distance $L_2$ between the first resistor element 131 and the left end edge 10*a* of the substrate 10 as well as the distance $L_2$ between the fourth resistor element 134 and the left end edge 10*b* of the substrate 10 can enlarged. Therefore, by utilizing this enlarged distance $L_2$, there is an enough room for arranging the longitudinally spaced end edges 14*a* of the undercoat layer 14 at positions beyond the first resistor element 131 and the fourth resistor element 134. Further, the enlarged distance $L_2$ also provides an enough room for arranging the longitudinally spaced end edges 15*a* of the middle-coat layer 15 at the same positions as or beyond the end edges 14*a* of the undercoat layer 14, and for arranging the longitudinally spaced end edges 16*a* of the overcoat layer 16 beyond the end edges 15*a* of the middle-coat layer 15. As a result, even if the undercoat layer 14, the middle-coat layer 15 and the overcoat layer 16 are printed with a positional deviation relative to the printed position of the resistor elements 131–134, the resistor elements 131, 134 and the undercoat layer 14 are effectively prevented or restrained from being exposed from the end edges 16*a* of the overcoat layer 16, thereby reducing the occurrence of unexpected shorting at the time of performing a solder plating step for the electrodes.

Further, according to the present embodiment, the resistor elements 131–134 need not be slenderized in spite of positional offsetting thereof, so that the range of resistance adjustment will not be reduced.

Similarly to a conventional chip resistor, the multi-element type chip resistor according to the present embodiment may be conveniently manufactured by a thick-film printing method. Such a manufacturing method is described below with reference to FIGS. 4 through 10.

Figure 4:
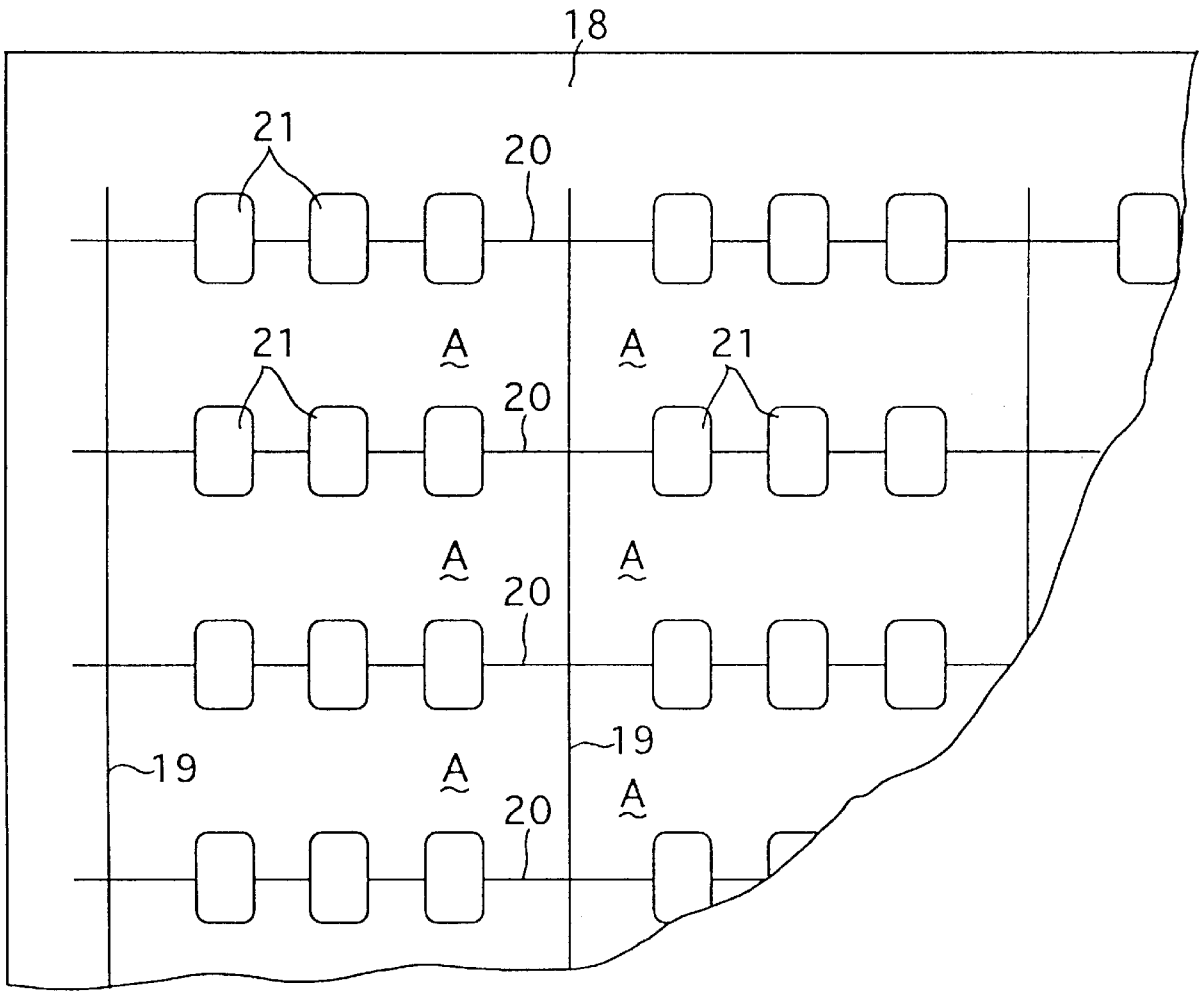
FIGS. 4 through 9 are fragmentary plan views showing the successive steps of making the chip resistor illustrated in FIGS. 1 through 3.

First, as shown in FIG. 4, a master substrate 18 is prepared which corresponds in size to a plurality of chip substrates 10. The master substrate 18, which is made of an insulating material such as alumina ceramic, has an obverse surface which is formed with vertical divisional grooves 19 and horizontal divisional grooves 20 in lattice-like arrangement to define generally rectangular unit regions A in plural rows and columns. Through-holes 21 are formed along the horizontal divisional grooves 20 for forming the above-described projections 11 (see FIG. 11) for the respective unit regions A. The vertical divisional grooves 19 and the horizontal divisional grooves 20 may be formed, for example, by pressing blades against a surface of an non-baked substrate green sheet. The through-holes 21 may be formed by punching the same substrate green sheet.

Figure 5:
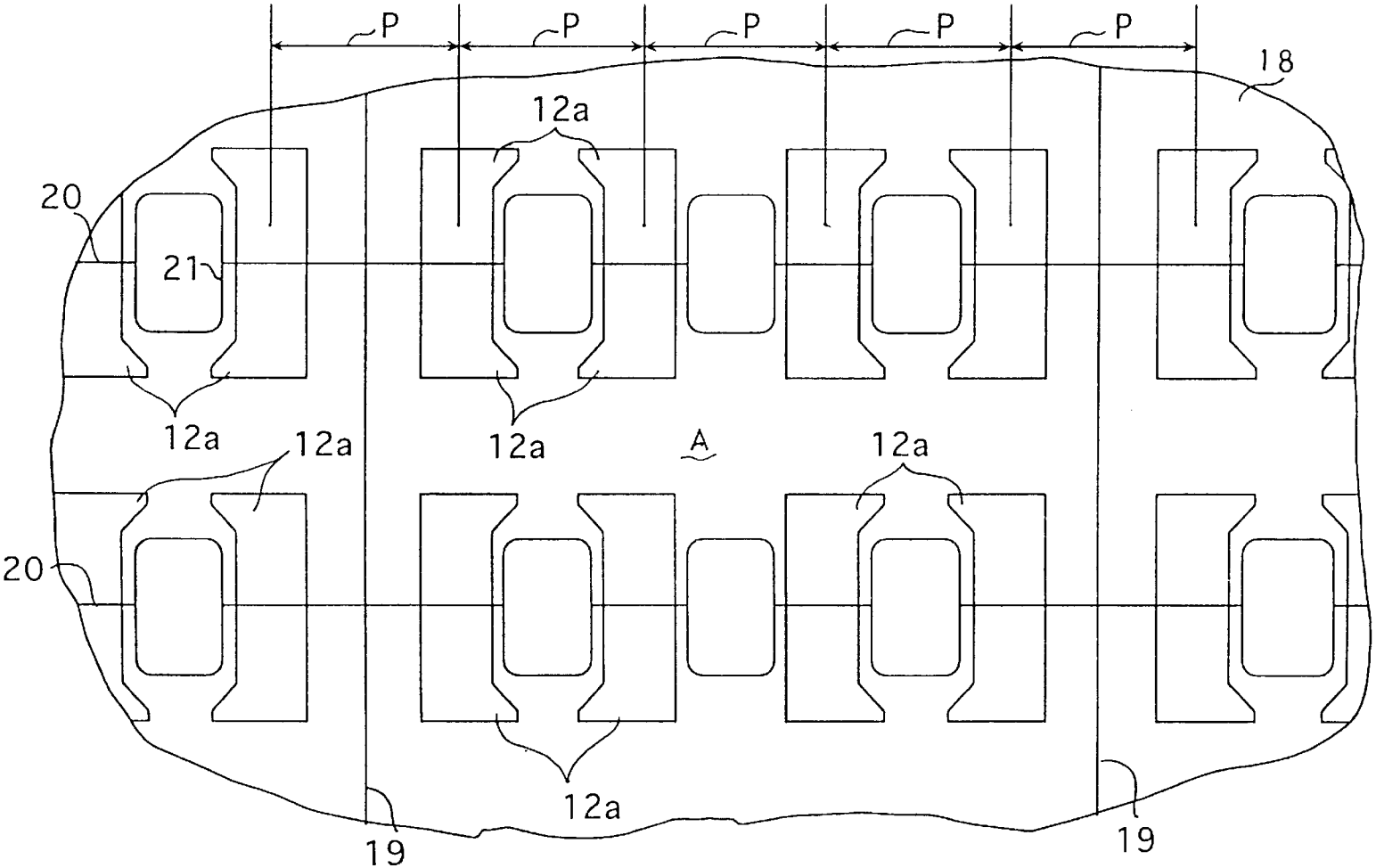

Then, as shown in FIG. 5, primary electrodes 12*a* are formed on predetermined portions of the master substrate 18. At this time, the pitch P for forming the primary electrodes 12*a* is constant not only in each individual unit region A but also throughout all unit regions A in each row.

Figure 6:
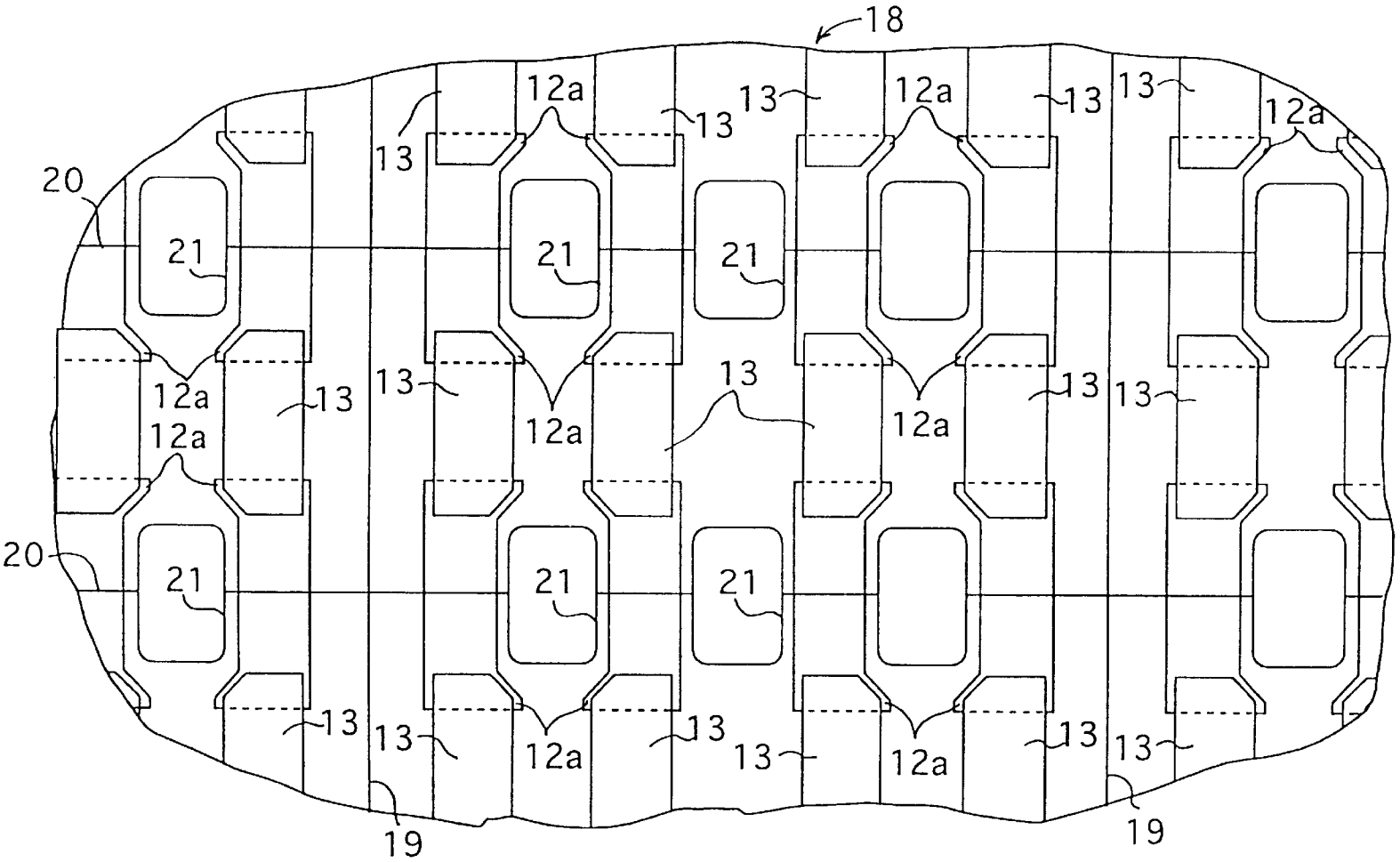

Then, as shown in FIG. 6, resistor elements 131–134 are formed to bridge between the corresponding pairs of electrodes 12*a* for each unit region A.

Figure 7:
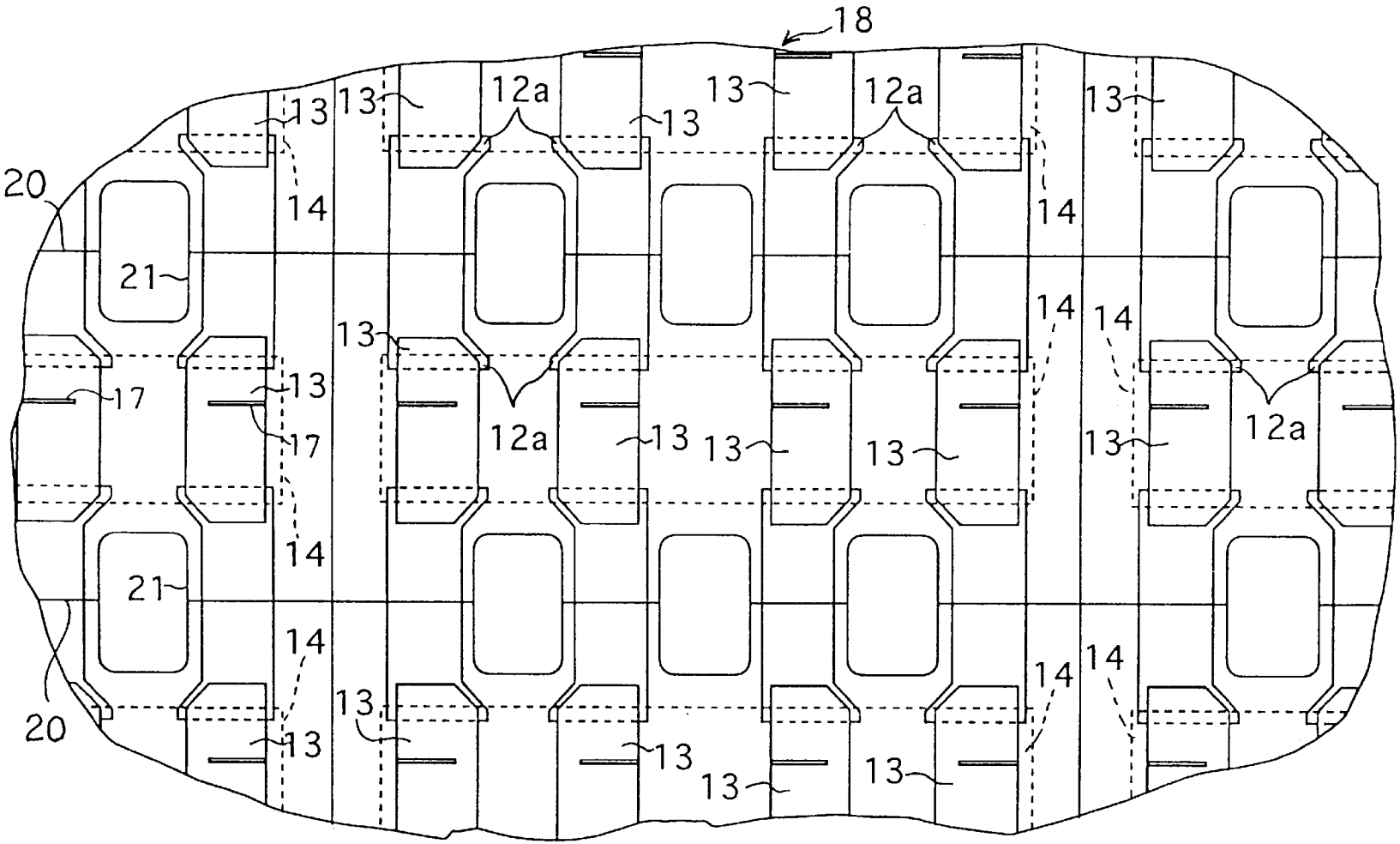

Then, as shown in FIG. 7, an undercoat layer 14 is formed to cover a train of resistor elements 131–134 in each unit region A. In this condition, measuring probes are brought into contact with each pair of electrodes 12*a* for measuring the resistance of the corresponding resistor element 131–134 and for adjusting the resistance of the respective resistor element to a predetermined resistance value by laser trimming (formation of a slit 17).

Figure 8:
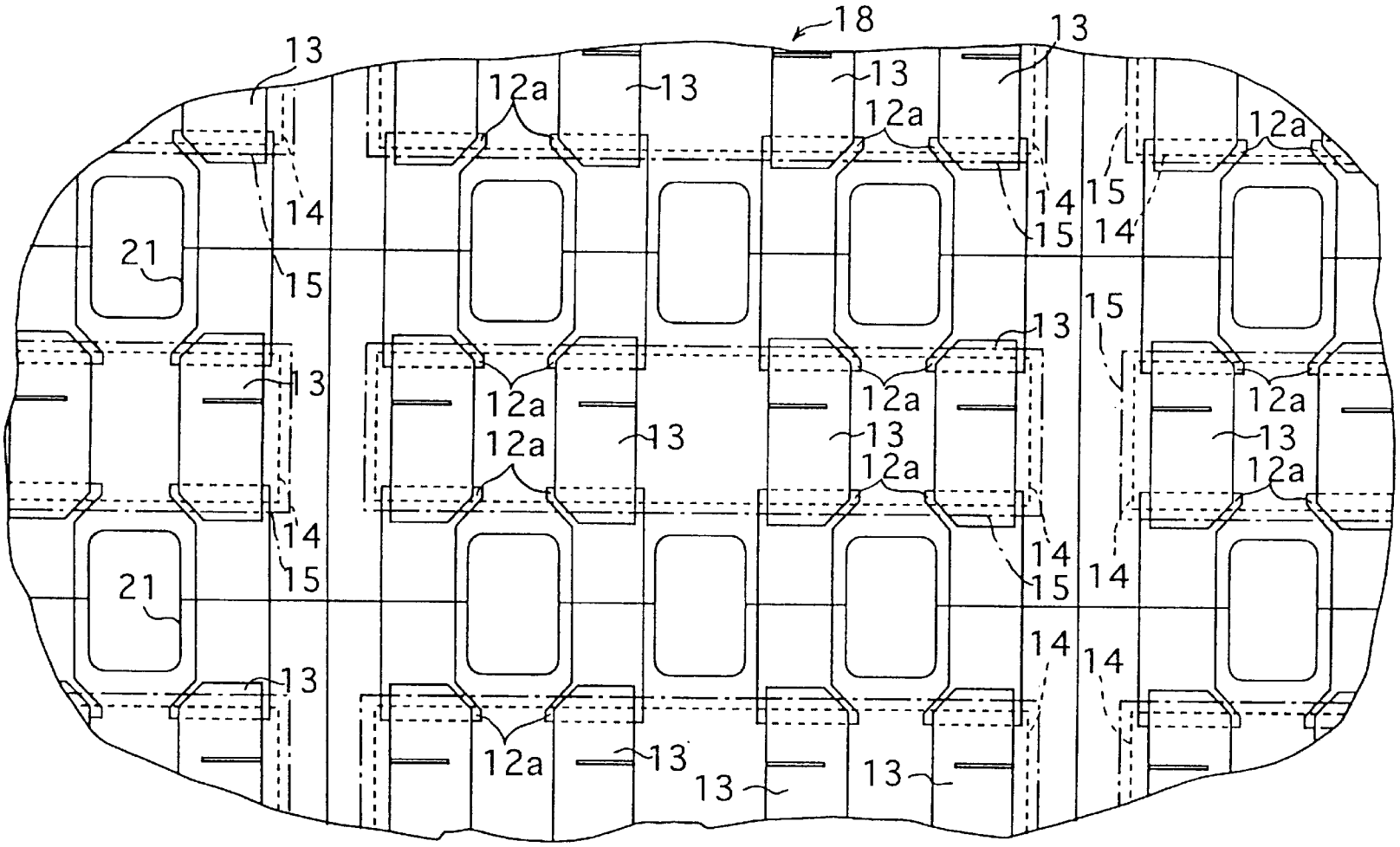

Then, as shown in FIG. 8, a middle-coat layer 15 is formed to cover the undercoat layer 14 in each unit region A.

Figure 9:
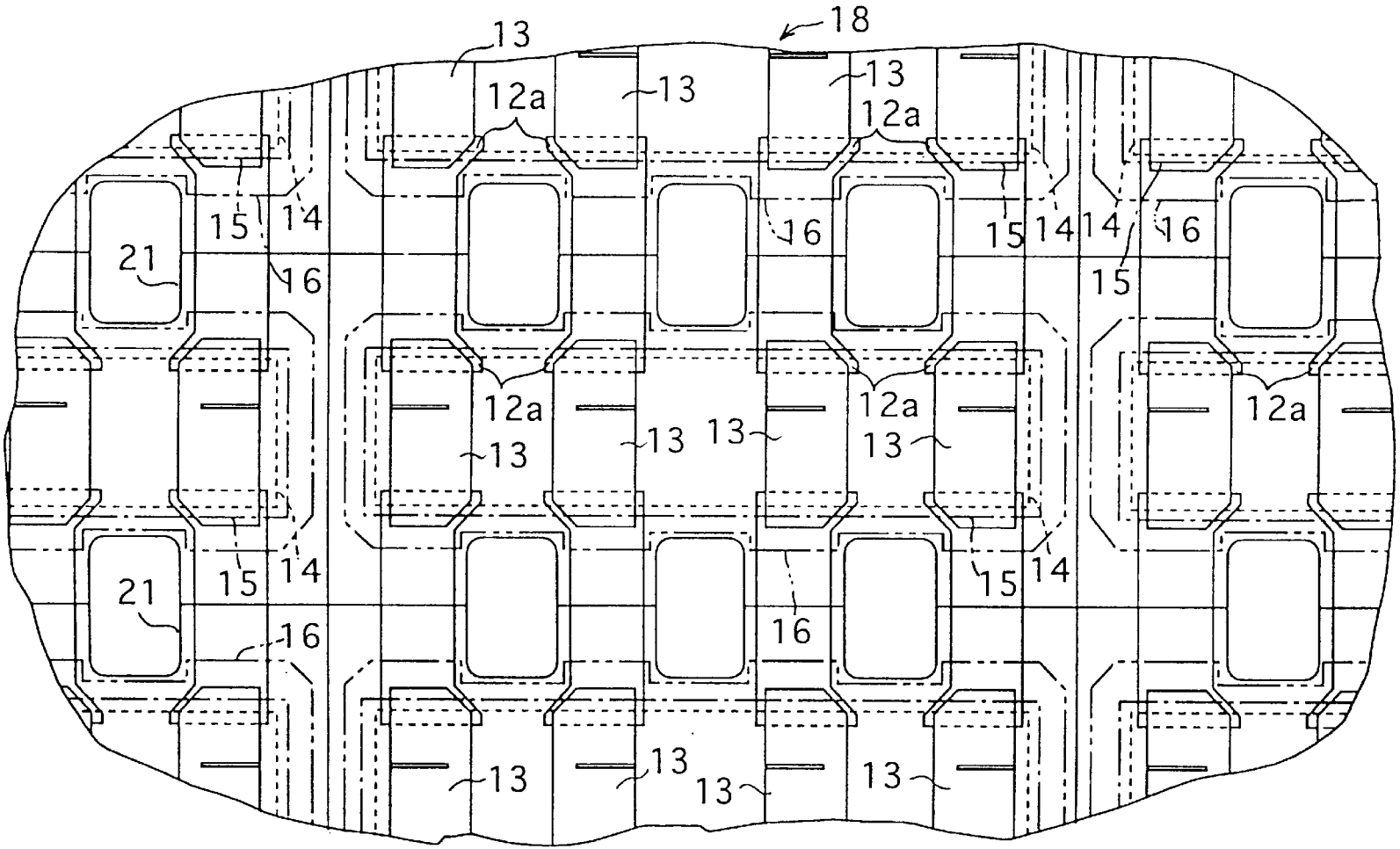

Then, as shown in FIG. 9, an overcoat layer 16 is formed to cover the middle-coat layer 15 in each unit region A.

Then, the master substrate 18 which has undergone the formation of the overcoat layer 16 is divided into substrate bars (not shown) by cutting along the horizontal divisional grooves 20 and a conductive paste is applied to each substrate bar and baked to form secondary electrodes 12*b* (FIG. 2) which extend onto the reverse surface of the substrate bar into conduction with the secondary electrodes 12*a*.

Finally, the substrate bars are divided along the vertical divisional grooves 19, thereby providing a plurality of multi-element type chip resistors having the structure illustrated in FIGS. 1 through 3.

According to the process described above, since the undercoat layer 14, the middle-coat layer 15 and the overcoat layer 16 are formed independently for each unit region A of the master substrate 18 without extending over the vertical divisional grooves 19, the middle-coat layer 15 for example will not fill the vertical divisional grooves 19. Therefore, it is possible to appropriately divide the master substrate 18 along the divisional grooves 18, 19, thereby equalizing the configuration of the chip substrates.

Figure 10:
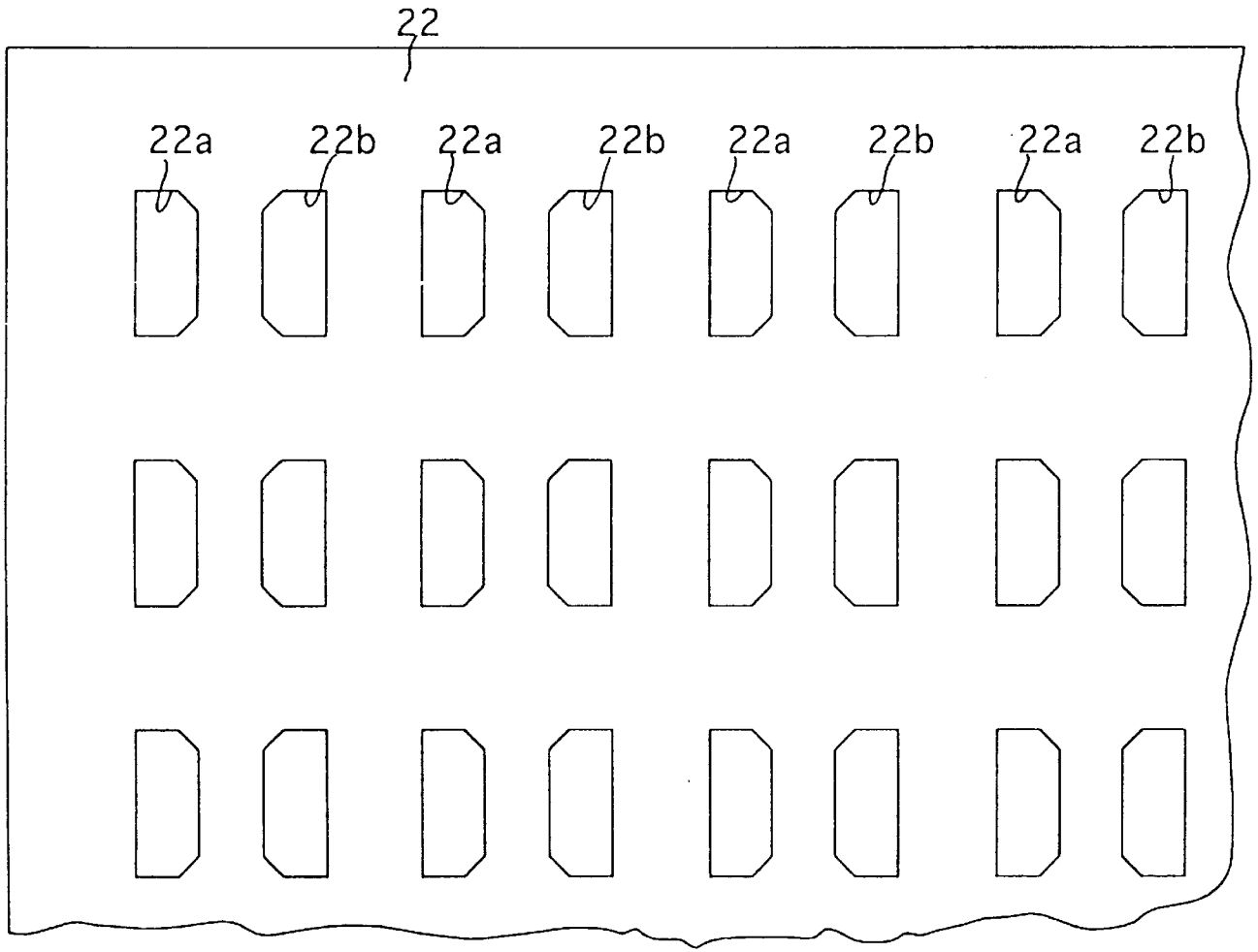
FIG. 10 is a fragmentary plan view showing a printing mask used for printing resistor elements in making the chip resistor illustrated in FIGS. 1 through 3.
Figure 11:
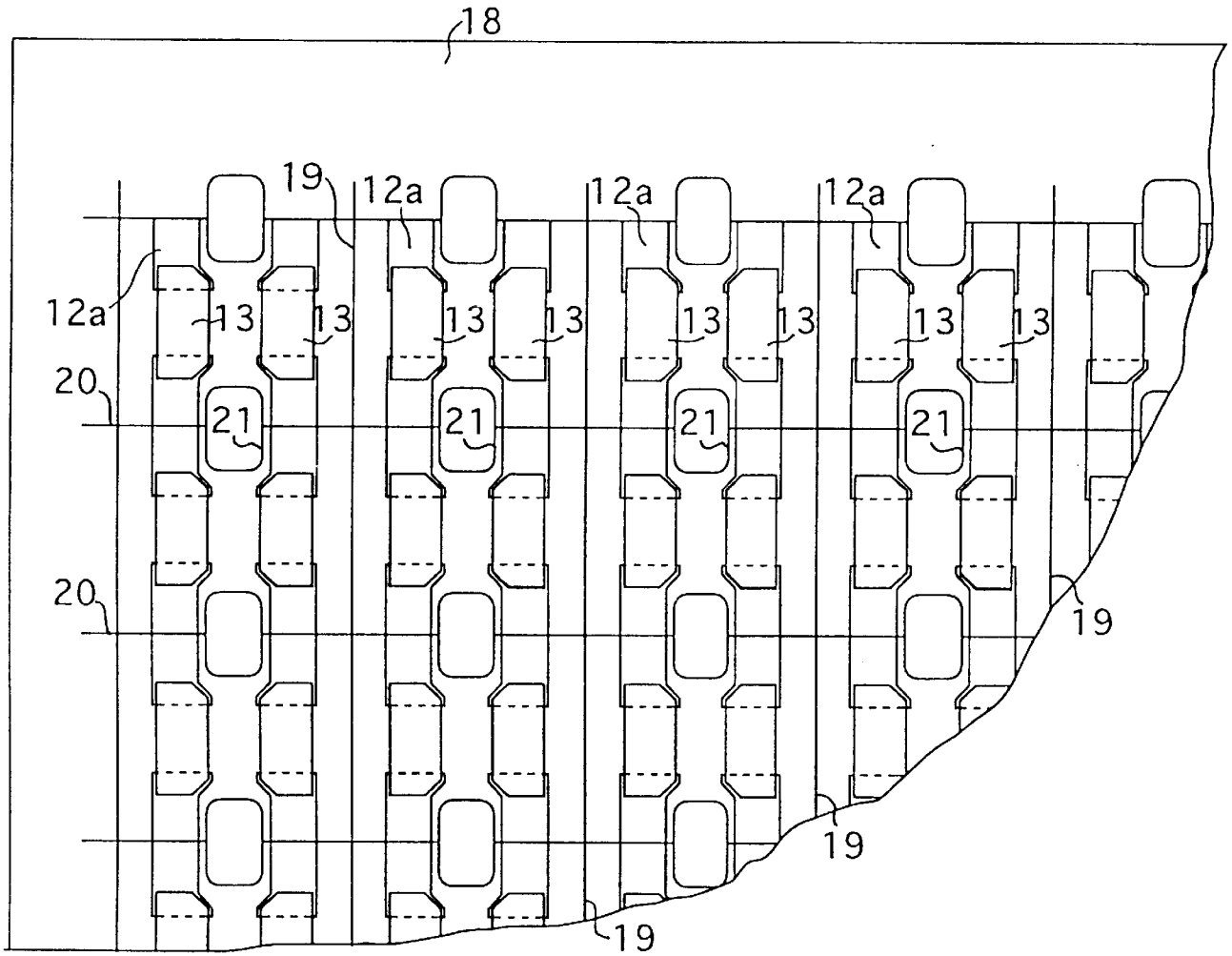
FIGS. 11 and 12 are fragmentary plan views showing two different master substrates to which the printing mask illustrated in FIG. 10 may be commonly applied.
Figure 12:
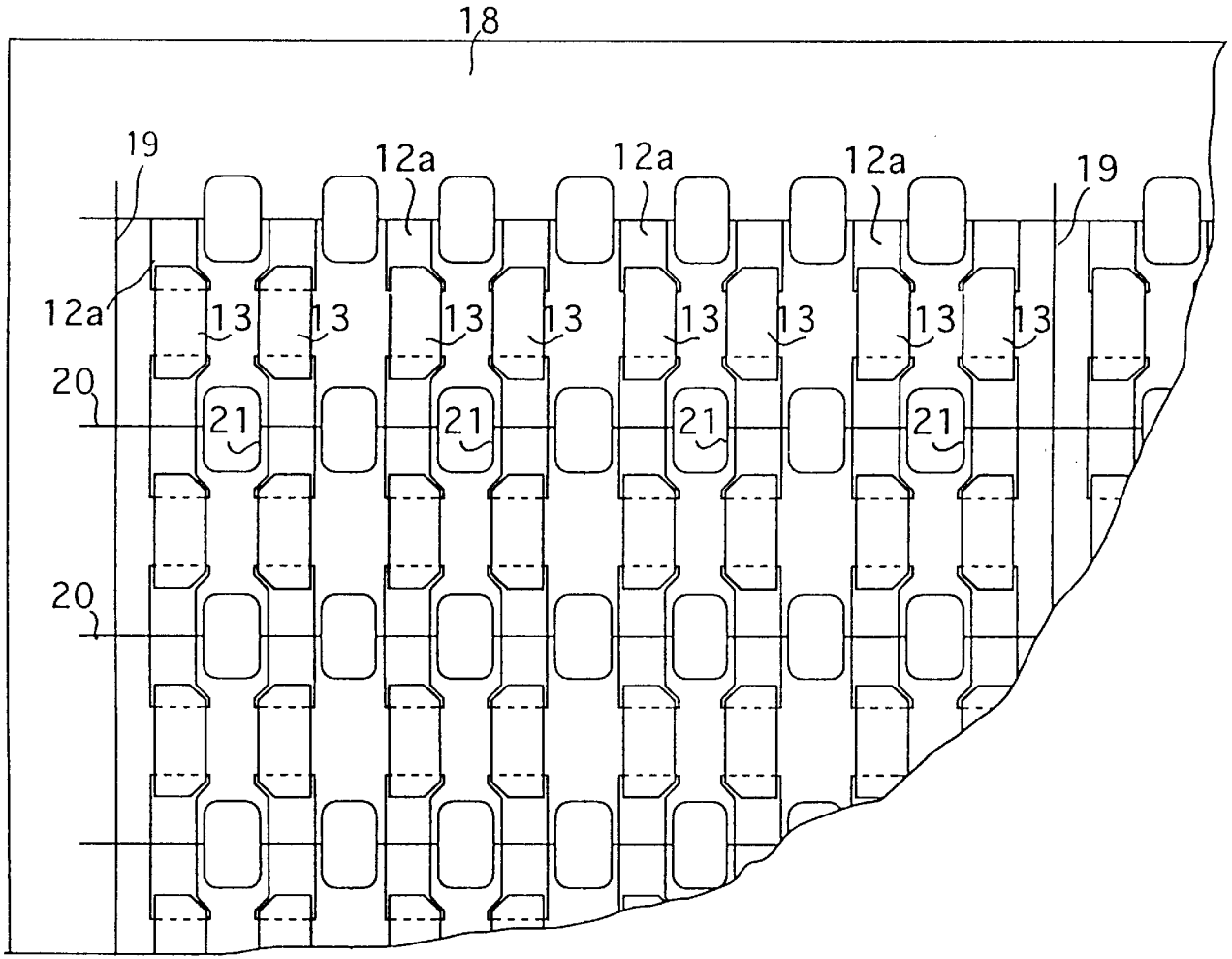

FIG. 10 schematically illustrates a mask 22 for printing the resistor elements 131–134. As understood from FIG. 10, the mask 22 has a plurality of mask openings 22*a*, 22*b* arranged in a plurality of horizontal rows. In each horizontal row, the odd-numbered mask openings 22*a* as counted from an end are offset toward the even-numbered mask openings 22*b*. The mask openings 22*a*, 22*b* correspond in configuration to the resistor elements 131–134 to be formed on the master substrate 18. As long as the pitch P for forming the primary electrodes 12*a* on the master substrate is held constant throughout each row of unit regions A, such a mask is commonly applicable to different master plates which are used for making a plurality of multi-element type chip resistors each having 2n resistor elements. For instance, the mask 22 is commonly applicable to a master plate which is used for making a plurality of multi-element type chip resistors each having two resistor elements as shown in FIG. 11, or to a master plate which is used for making a plurality of multi-element type chip resistors each having eight resistor elements as shown in FIG. 12.

While the above embodiment refers to a multi-element type chip resistor, the present invention is not limited to a chip resistor. For instance, the present invention is also applicable to a chip capacitor which includes a plurality of capacitor elements arranged on a single substrate in a row, or to a composite chip device which includes resistor elements and capacitor elements arranged on a single substrate. Though, in the illustrated embodiment, the protective coating has a triple-layer structure which includes the undercoat, middle-coat and overcoat layers equally made of a glass material, it need not has a triple-layer structure and may be made of a protective material other than glass.

I claim:

1. A multi-element type chip device comprising an elongate chip substrate; 2n pairs of opposed electrodes formed on a surface of the chip substrate at a generally constant interval longitudinally of the chip substrate, n representing a positive integer; device elements each of which is formed between a respective pair of electrodes and connected thereto selected from a group consisting of a resistor element and a capacitor element; and a protective coating formed to cover the device elements in a row extending longitudinally of the chip substrate;

wherein each device element has a widthwise direction extending longitudinally of the chip substrate;

wherein each electrode in the respective pair has a narrower base portion and an enlarged connecting portion; said each electrode having a widthwise direction extending longitudinally of the chip substrate;

wherein a (2m−1)th device element as counted from one end of the chip substrate has a widthwise center which is offset from a widthwise center of the base portion of each electrode in a corresponding pair toward the other end of the chip substrate, m representing a positive integer not exceeding n;

wherein a (2m)th device element as counted from said one end of the chip substrate has a widthwise center which is offset from a widthwise center of the base portion of each electrode in a corresponding pair toward said one end of the chip substrate; and wherein the connecting portion of each electrode in the respective pair has a widthwise center which is offset from the widthwise center of the base portion in the same direction as a corresponding device element.

2. The multi-element type chip device according to claim 1, wherein each of the device elements is a resistor element.

3. The multi-element type chip device according to claim 1, wherein the protective coating comprises an undercoat layer formed to cover the device elements in a row extending longitudinally of the chip substrate, a middle-coat layer formed to cover the undercoat layer, and an overcoat layer formed to cover the middle-coat layer.

4. The multi-element type chip device according to claim 3, wherein the undercoat layer extends longitudinally of the chip substrate throughout and beyond all of the device elements, the middle-coat layer extending longitudinally of the chip substrate at least as much as the undercoat layer extends, the overcoat layer extending longitudinally of the chip substrate to a position beyond the middle-coat layer but short of each edge of the chip substrate.

5. A process for making multi-element type chip devices comprising the steps of:

preparing a master substrate formed with vertical divisional grooves and horizontal divisional grooves for defining elongate unit regions arranged in plural rows and columns;

forming 2n pairs of opposed electrodes in each unit region at a generally constant interval longitudinally thereof, n representing a positive integer;

forming device elements each of which extends between a respective pair of electrodes wherein the device elements are connected to the electrodes in said each unit region and is selected from a group consisting of a resistor element and a capacitor element; and forming a protective coating to cover the device elements in a row extending longitudinally of the chip substrate;

wherein each device element has a widthwise direction extending longitudinally of said each unit region;

wherein each electrode in the respective pair has a narrower base portion and an enlarged connecting portion, said each electrode having a widthwise direction extending longitudinally of said each unit region;

wherein a (2m−1)th device element as counted from one end of said each unit region has a widthwise center which is offset from a widthwise center of the base portion of each electrode in a corresponding pair toward the other end of said each unit region, m representing a positive integer not exceeding n;

wherein a (2m)th device element as counted from said one end of said each unit region has a widthwise center which is offset from a widthwise center of the base portion of each electrode in a corresponding pair toward said one end of said each unit region; and wherein the connecting portion of each electrode in the respective pair has a widthwise center which is offset from the widthwise center of the base portion in the same direction as a corresponding device element.

6. The process according to claim 5, wherein each of the device elements is a resistor element.

7. The process according to claim 5, wherein the protective coating is formed by successively forming an undercoat layer covering the device elements in a row extending longitudinally of said each unit region, a middle-coat layer covering the undercoat layer, and an overcoat layer covering the middle-coat layer.

8.The process according to claim 7, wherein the undercoat layer is formed to extend longitudinally of said each unit region throughout and beyond all of the device elements, the middle-coat layer being formed to extend longitudinally of said each unit region at least as much as the undercoat layer extends, the overcoat layer being formed to extend longitudinally of said each unit region to a position beyond the middle-coat layer but short of each edge of said each unit region.

9. The process according to claim 5, wherein the interval between all pairs of electrodes in each row of unit regions is constant throughout said each row of unit regions.

* * * * *